United States Patent [19]

Ichida et al.

[11] Patent Number: 4,704,167

[45] Date of Patent: Nov. 3, 1987

[54] METHOD AND APPARATUS FOR COOLING STEEL STRIP

[75] Inventors: Kozaburo Ichida; Norichika Nagira; Mineo Murata; Tadashige Namba, all of Kitakyushu, Japan

[73] Assignee: Nippon Steel Corporation, Tokyo, Japan

[21] Appl. No.: 831,433

[22] Filed: Feb. 20, 1986

[30] Foreign Application Priority Data

Feb. 21, 1985 [JP] Japan ..... 60-31421

[51] Int. Cl.[4] ..... C21D 9/52

[52] U.S. Cl. ..... 148/153; 148/156; 266/109; 266/111

[58] Field of Search ..... 148/153, 156; 266/102, 266/109, 111

[56] References Cited

FOREIGN PATENT DOCUMENTS 56-41321 4/1981 Japan .

*Primary Examiner*—R. Dean

*Attorney, Agent, or Firm*—Wenderoth, Lind & Ponack

[57] ABSTRACT

In a cooling zone of a continuous annealing line engineered to continuously process longitudinally travelling steel strip, the strip is first slowly cooled to a desired temperature at a rate of not higher than 20° C./sec. by means of a jet stream of cooling gas ejected against the surface of the strip and subsequently quenched to a desired temperature at a rate of not lower than 70° C./sec. Thinner strip is quenched by high-speed gas-jet cooling that is effected by ejecting a jet stream of cooling gas against its surface, while heavier strip is quenched by bringing it into contact with the perimeter of cooling rolls cooled by a coolant. Namely, quenching is achieved either by high-speed gas-jet cooling or roll cooling depending on the thickness of the strip being processed. A cooling apparatus for implementing the cooling method described above comprises a high-speed gas-jet cooling zone where the strip is cooled by means of a jet stream of cooling gas ejected against its surface and a roll cooling zone following the high-speed gas-jet cooling zone where the strip is brought into direct contact with a plurality of cooling rolls. Means to exert longitudinal tension on the strip travelling through the roll cooling zone are provided at the entry and exit ends thereof.

9 Claims, 11 Drawing Figures

METHOD AND APPARATUS FOR COOLING STEEL STRIP

BACKGROUND OF THE INVENTION

1. Field of the Invention

This invention relates to a method and apparatus for cooling steel strip, and more particularly to a method and apparatus for cooling steel strip of various thicknesses optimum for use in a cooling zone of a continuous annealing line.

2. Description of the Prior Art

Gas-jet cooling, cooled-rolls contact cooling, combinations of the above two (such as a method disclosed in Japanese Provisional Patent Publication No. 41321-1981) and several other methods have been proposed as means of cooling steel strip in continuous annealing equipment. Gas-jet cooling comprises shooting forth a jet stream of furnace atmosphere gas cooled in the cooling zone of a continuous annealing furnace against the surface of steel strip. Cooling by contact with cooled rolls is effected by bringing steel strip into contact with rolls cooled with a coolant passed along the inside perimeter of the roll body.

Using a furnace atmosphere gas and keeping the strip out of physical contact, gas jet cooling has a merit of high operational efficiency. On the other hand, cooling by contact with cooled rolls has recently attracted increasing attention because of a high cooling rate it achieves by bringing strip into direct contact with rolls.

But these methods are not without problems. With gas-jet cooling, high cooling rate becomes difficult to attain as strip thickness increases. When a thinner and wider strip is cooled with cooled rolls, a slight temperature variation across the strip width can lead to undesirable fracture or drawing on account of the low rigidity instrinsic to thinner strip. Setting aside such fracture and drawing, uniform distribution of tension across the strip width may be impaired, whereupon it becomes difficult to keep strip in uniform contact with the surface of cooled rolls widthwise, with ensuring uneven cooling.

SUMMARY OF THE INVENTION

An object of this invention is to provide a method and equipment for consistently cooling steel strip of whatever size with a desired cooling rate, solving the problems with the conventional gas-jet and cooled-roll strip cooling technologies.

Another object of this invention is to provide a method and apparatus ensuring uniform widthwise cooling of steel strip of whatever thickness.

In order to achieve the above objects, a strip cooling method according to this invention comprises slowly cooling longitudinally travelling steel strip to a desired temperature at a cooling rate of not higher than 20° C./sec with a coolign gas ejected against the surface of the strip in a cooling zone of a continuous annealing furnace in which the running strip is continuously processed. Then, the strip is quenched to a desired temperature with a cooling rate of not lower than 70° C./sec. The desired quenching is achieved with thinner materials that can be quenched at a rate of not lower than 70° C./sec with a high-seed gas jet that is ejected against the strip surface. On the other hand, heavier materials may not be quenched at a rate of not lower than 70° C./sec by high-speed gas jet cooling. Quenching of such heavier materials is then achieved by bringing the strip in contact with the surface of coolant-cooled rolls. For achieving the desired quenching, in other words, high-speed gas-jet cooling or cooled-roll cooling is chosen depending on the thickness of the strip processed. The rates of slow cooling and quenching depend on the metallurgical requirements of finished product. Water or heat-transfer mediums having high boiling points (such as diphenyl-based ones having a boiling point of 250° C. to 300° C.) are used as a roll-cooling coolant.

An apparatus to implement the above cooling method comprises a high-speed gas-jet cooling zone where steel strip is cooled by a jet stream of cooling gas ejected against the surface thereof and a roll cooling zone disposed immediately downstream of the high-speed gas-get cooling zone where the strip is cooled by direct contact with cooling rolls. Means to exert a high tension on the strip running through the roll-cooling zone are provided at the entry and exit end of the roll-cooling zone.

As mentioned above, the technology of this invention is characterized by the combination of high-speed gas-jet cooling and roll cooling. When thinner strip is passed, cooling is effected by only high-speed gas-jet cooling, with the cooling rolls retracted away from the strip. With heavier strip, uniform cooling throughout the stock is achieved by applying gas-jet cooling preliminary to roll cooling.

According to the technology of this invention, steel strip in a wide thickness range (such as from 0.3 mm to 2.0 mm) can be continuously annealed on a single line. Attainable benefits are efficient continuous annealing and remarkably increased productivity. A choice of a cooling method or apparatus suited for a specific strip thickness ensures achievement of uniform cooling and production of good-quality strip. Conventionally, widthwise temperature variations have often occurred (i.e., between the strip edge and center) upstream of the cooling zone particularly on heavier materials (such as those having a thickness of 0.7 mm or above). According to this invention, such temperature inequalities can be eliminated in the high-speed gas-jet cooling zone prior to the application or roll cooling.

Exertion of tension on the strip causes the surface of the strip to adhere uniformly to the perimeter of cooling rolls, thereby insuring uniform cooling across the width of the strip.

DESCRIPTION OF THE PREFERRED EMBODIMENTS

Referring now to accompanying drawings, a cooling apparatus embodying the principle of this invention will be described.

Figure 1:
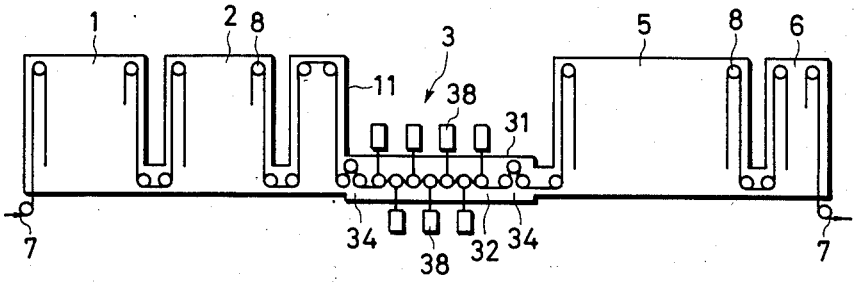
FIG. 1 is a schematic diagram of continuous strip annealing line incorporating a cooling apparatus according to this invention.

FIG. 1 schematically shows a continuous annealing line incorporating a cooling apparatus according to this invention. As seen in the diagram, the continuous annealing line comprises a heating furnace 1, a soaking furnace 2, a primary cooling furnace 3, an overaging furnace 5 and a secondary cooling furnace 6 which are sequentially disposed, with provision made to continuously pass steel strip S therethrough over a number of hearth rolls 8 or other appropriate means. The hearth rolls 8 are driven by a drive unit (not shown) comprising a motor, speed reducer and so on. Passed over the hearth rolls 8, the strip S travels up and down through each furnace. The continuous annealing line is preceded and followed by such ordinary equipment as a payoff reel, welder, electrolytic cleaner, entry-side looper, exit-side looper, skinpass mill, shear and tension reel (not shown).

The cooling apparatus of this invention is characterized by the primary cooling furnace 3 which comprises a high-speed gas-jet cooling zone 11 and a subsequent roll cooling zone 31.

Figure 2:
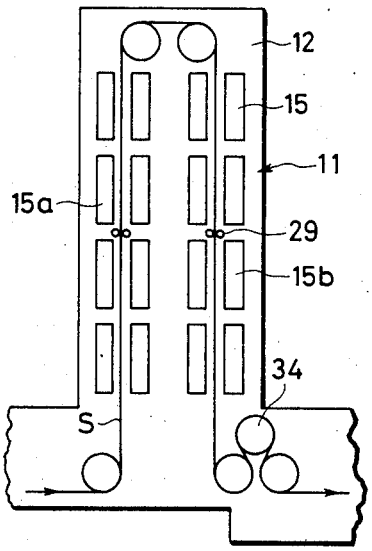
FIG. 2 is a schematic overall view showing a concrete example of a high-speed gas-jet cooling zone according to this invention.
Figure 3:
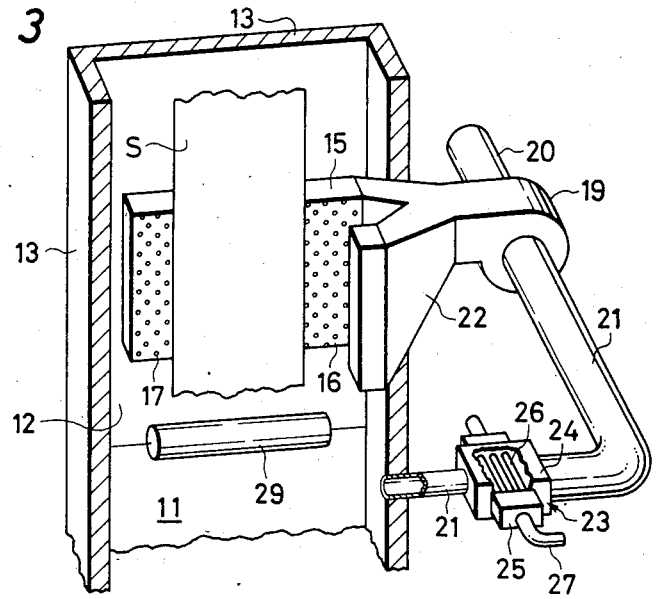
FIG. 3 is a detail view showing a cooling apparatus in the high-speed gas-jet cooling zone.

A concrete example of the high-speed gas-jet cooling zone 11 is shown in FIGS. 2 and 3. The high-speed gas-jet cooling zone 11 has a vertical furnace chamber 12, in which pairs of gas ejection boxes 15 are disposed on both sides of the vertical pass line of the strip S and mounted on furnace walls 13. A large number of nozzles 17 to eject a cooling gas against the strip S are provided on that surface 16 of the gas ejection box 15 which faces the strip S. A circulating fan 19 is provided outside the furnace chamber 12 and driven by a motor 20. The circulating fan 19 has an intake pipe 21 whose end opens into the furnace chamber 12 and a discharge pipe 22 connected to the gas ejection box 15. A cooling heat exchanger 23 is provided midway on the intake pipe 21. The heat exchanger 23 has a large number of fin tubes 26 extended across a chamber 24 therein. Both ends of the fin tube 26 are fastened to headers 25 fitted on the side walls of the chamber 24, with cooling water supplied to the headers 25 form a cooling water pipe 27. The furnace atmosphere gas admitted into the intake pipe 21 is cooled to a desired temperature on comining in contact with the fin tubes 26 in the cooling heat exchanger 23, with the pressure thereof boosted by the circulation fan 19. The boosted cooling gas is ejected in jet streams toward the surface of the strip S to be cooled from the nozzles 17 on the gas ejection box 15. Support rolls 29 are provided at appropriate intervals to suppress the fluttering of the strip S between the vertically adjoining gas ejection boxes 15. The support rolls 29 are driven synchronously with the travelling strip S and equipped with a mechanism (not shown) to retract away from the strip S when the line is stopped or on some other occasions.

As shown in FIG. 1, the roll cooling zone 31 has a horizontally extending furnace chamber 32 through which the strip S travels horizontally. Bridle rolls 34 to exert tension on the strip S are provided at the entry and exit ends of the furnace chamber 32. Between the bridle rolls 34, there are provided water-cooled rolls 36 that are offset with respect to each other on both sides of the pass line of the strip S. Cooling water to cool the roll surface is passed each water-cooled roll 36. The cooling roll 36 is driven and pushed up and down by a drive unit 38, thereby coming in and out of contact with the strip S.

Figure 4:
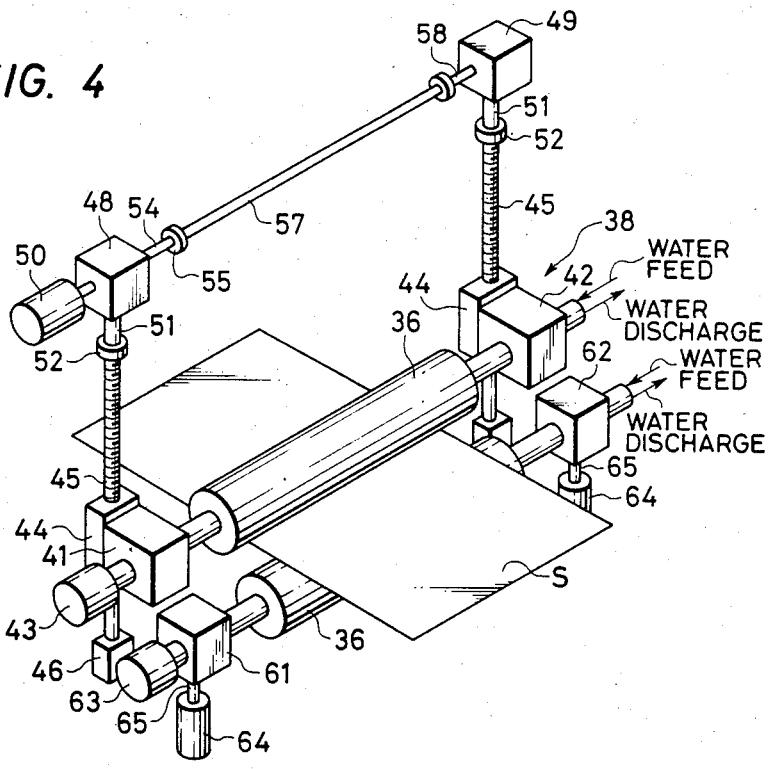
FIG. 4 is a perspective view showing details of a drive mechanism of a roll cooling zone.

FIG. 4 shows details of the drive unit 38. As seen the upper water-cooled roll 36 is rotatably supported at both ends thereof by elevatable bearing boxes 41 and 42 and rotated by a motor 43 connected to one end of the shaft thereof extending through the bearing box 41 by way of a coupling. The water-cooled roll 36 is driven in such a manner that the peripheral speed thereof is equal to the travel speed of the strip S. Through a support 44 for each of the bearing boxes 41 and 42 is vertically passed a screw shaft 45 whose lower end is supported by a bearing 46. The support 44 for each of the bearing boxes 41 and 42 contains a screw block (not shown) with which the screw shaft 45 is engaged. Miter gear boxes 48 and 49 facing each are provided above the supports 44 of the bearing boxes 41 and 42. A motor 50 to drive a bevel gear is fitted to the miter gear box 48, with an output shaft 51 extending downward therefrom connected to said screw shaft 45 through a coupling 52. Another output shaft 54 horizontally extending from the miter gear box 48 is connected to an input shaft 58 of the opposite miter gear box 49 through a coupling 55 and an intermediate shaft 57. An output shaft 51 of the miter gear box 49 is also connected to the screw shaft 45. As the motor 50 drives the screw shaft 45, the water-cooled roll 36 moves up and down through the supports 44 of the heating boxes 41 and 42.

Similarly, the lower water-cooled roll 36 is rotatably supported at both ends thereof by elevatable bearing boxes 61 and 62 and driven by a motor 63 that is fitted via a coupling to one end of the shaft thereof extending through the bearing box 61. A rod 65 of a hydraulic cylinder 64 is connected to the bottom of each of the bearing boxes 61 and 62 so that the bearing boxes 61 and 62 or the water-cooled roll 36 is moved up and down by the motion of the hydraulic cylinder 64.

Water to cool the water-cooled rolls is supplied through rotary joints (not shown) connected to those shaft ends thereof passing through the bearing boxes 42 and 62. Thus, the water-cooled rolls 36 are cooled by the water circulated therethrough by way of the cooling water pipe.

Figure 5:
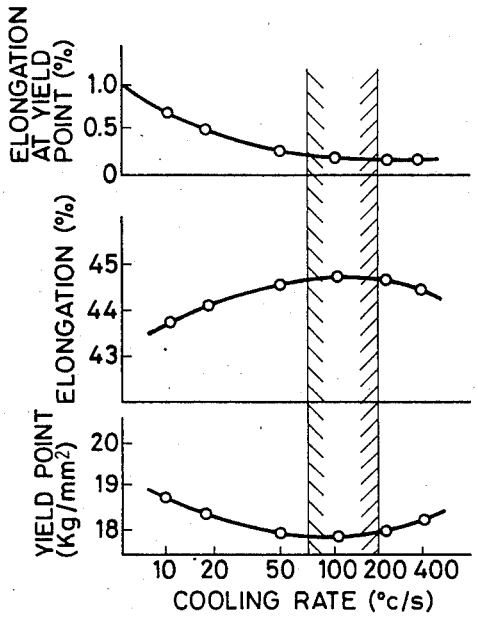
FIG. 5 graphically shows the relationship between the mechanical properties of steel strip and the cooling rate.

Next, the reason why the high-speed gas-jet cooling zone 11 and the roll-cooling zone 31 are provided side by side will be discussed in terms of the relationship with the cooling rate. First, the influence of the cooling rate on the mechanical properties of the continuously annealed strip is as shown in FIG. 5; minimum yield point and maximum elongation are obtained when the cooling rate is between not lower than 70° C./sec and not higher than 200° C./sec. In other words, cooling rates within this range is desirable from the viewpoint of mechanical properties.

Figure 6:
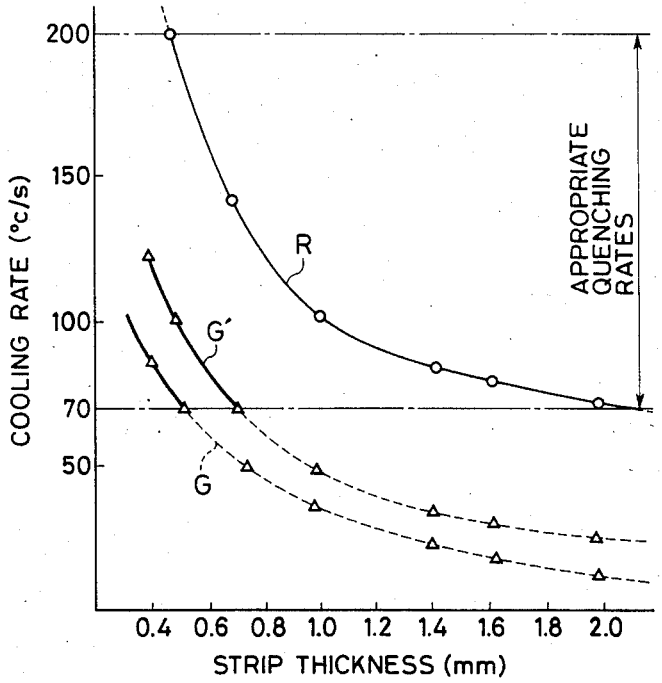
FIG. 6 graphically shows the relationship between the strip thickness and the cooling rate.

FIG. 6 shows the relationship between the strip thickness and cooling rate studied in relation to high-speed gas-jet cooling and roll cooling. In the figure, curves G and G′ exhibit examples of high-speed gas-jet cooling while curve B shows an example of roll cooling. As indicated by curve R, the cooling rate of roll cooling exceeds the aforementioned upper limit of 200° C./sec when strip thickness is under 0.5 mm. Hence, it is desirable to cool strip thinner than 0.5 mm by high-speed gas-jet cooling. Curve G shows an example in which 0.5 mm thick strip is cooled by a high-speed gas-jet at a cooling rate of 70° C./sec. Curve G' shows an example in which high-speed gas-jet cooling is achieved at practically the highest cooling rate allowable in view of equipment cost. (Cooling facilities operating at higher cooling rates might be prohibitive from an economical viewpoint.) In order to achieve a cooling rate within the desirable range (70° C./sec to 200° C./sec) mentioned before, therefore, a choice must be made between high-speed gas-jet cooling and roll cooling within the range in which curves G and G' of high-speed gas-jet cooling and curve R of roll cooling are indicated by solid lines. While high-speed gas-jet cooling is preferable for strip thinner than 0.5 mm, the desired cooling rate is difficult to obtain with strip heavier than 0.7 mm without employing roll cooling. For strip ranging between not less than 0.5 mm and not more than 0.7 mm in thickness, either high-speed gas-jet cooling or roll cooling may be chosen so far as the cooling rate of 70° C./sec minimum is attainable. The choice between the two methods depends on the capacity of the cooling equipment involved. The aforementioned range of strip thickness can vary to some extent depending on the capacity of the cooling equipment employed and the temperature variations demanded of the steel strip processed. The range given before is practical example to which this invention is by no means limited.

Figure 7:
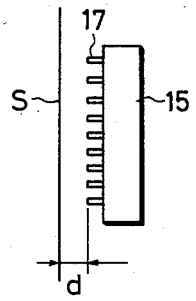
FIG. 7 is a side elevation of a gas ejection box in the high-speed gas-jet cooling zone.

To achieve effective high-speed gas-jet cooling, it is preferable to keep the distance "d" between the tip of the gas nozzle 17 and the surface of the strip S at 100 mm or under as shown in FIG. 7. Bringing the gas nozzle 17 close to the strip permits greater heat transfer, reduces the power requirement of the circulation fan 19, and ensures a closely controlled change in the temperature distribution throughout the strip that is conductive to the entry-side temperature distribution control for the subsequent roll cooling operation. The power of the circulation fan 19 tends to increase sharply when the distance "d" exceeds 100 mm, although the tendency varies with nozzle specifications. The distance "d" should preferably be not smaller than 30 mm since the surface of the strip S might come in contact with the tip of the gas nozzle 17 when fluttering if the distance "d" is too small.

Figure 8:
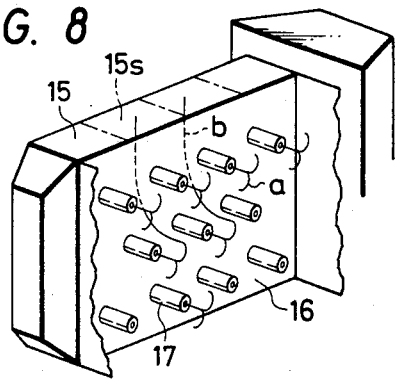
FIG. 8 is a schematic view illustrating the flow of an ejected gas stream.

The nozzles 17 should preferably be of the projected type as shown in FIG. 7 or FIG. 8. If a jet stream of gas hitting the surface of the strip hovers thereover, gases ejected thereafter may be prevented from reaching the strip surface, with a resulting drop in cooling efficiency. The nozzles 17 of the projected type leave enough space for the escape of cooling gases between the strip and the facing side of the gas ejection box. As a consequence, a jet gas stream "a" ejected against the strip S flows away to permit the following gas streams to flow smoothly, whereby the strip S is at all times exposed to freshly supplied cooling gas and greater heat transfer ensues.

It is also preferable to divide the gas ejection box 15 widthwise into multiple zones as indicated by dot-dash lines in FIG. 8 to permit a widthwise adjustment of strip temperature through the control of the gas ejection rate in each zone 15*s*. This provision assures uniform widthwise temperature distribution in thinner strip (such as not more than 0.7 mm). Also, the widthwise temperature distribution in materials heavier than 0.7 mm in thickness can be controlled with the shape and temperature distribution after roll cooling in mind.

The cooling rate of gas-jet slow cooling is controlled by ajdusting the volume of cooling gas supplied and the length of the strip over which cooling gas is ejected (i.e., the number of gas ejection boxes turned on). To lower the cooling rate, for example, either the rotational speed of the cooling gas circulation fan is lowered or the damper opening is throttled and more gas ejection boxes are set to work.

Furthermore, the gas-jet cooling zone 11 may be divided into a slow cooling zone 15*a* (see FIG. 2) for thinner materials outfitted with common gas ejecting means on the soaking furnace side and a high-efficiency cooling zone 15*b* equipped with high-speed gas ejecting means on the roll cooling zone side.

Figure 9:
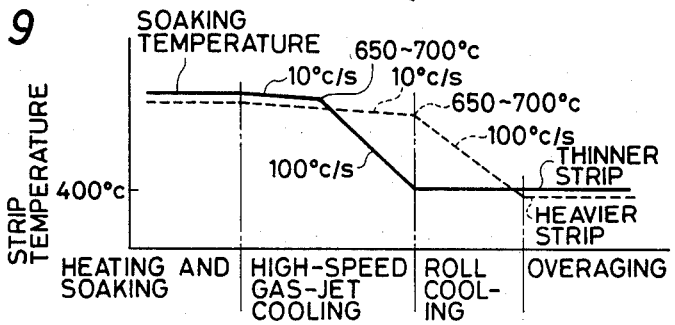
FIG. 9 graphically shows examples of the heat cycles of thinner (indicated by a solid line) and heavier (indicated by a dotted line) materials processed by the cooling apparatus according to this invention.
Figure 10A:
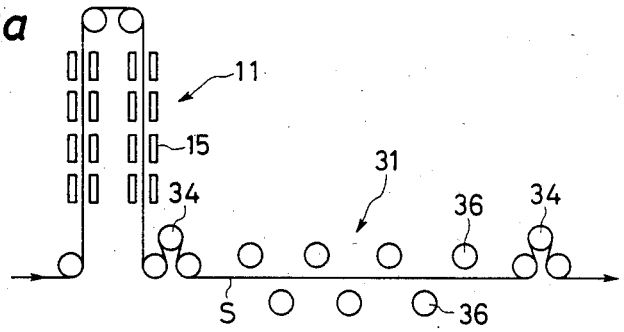
FIG. 10 shows operations with and without roll cooling effected in the roll cooling zone at (a) and (b), respectively.
Figure 10B:
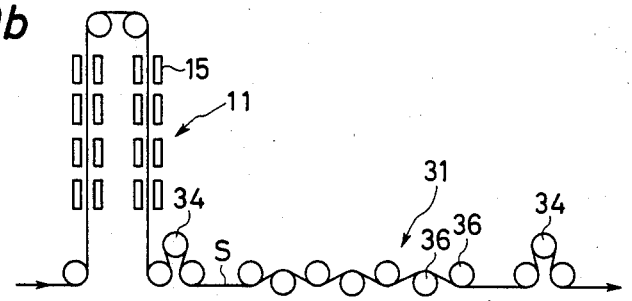

The following paragraphs describe a continuous annealing operation implemented by use of the cooling apparatus just described. FIG. 9 shows examples of heat cycles for a thinner stock (indicated by a solid line) and a heavier stock (indicated by a broken line) and a heavier stock (indicated by a broken line) processed on the cooling apparatus according to this invention. Strip passes through a heating and soaking zone, high-speed gas-jet cooling zone, roll cooling zone and overaging zone in that order. The thinner strip (0.5 mm thick in the illustrated example) is slowly cooled (at a cooling rate of 10° C./sec in the illustrated example) in the high-speed gas-jet cooling zone until quenching begins, and then quenched at a cooling rate of not lower than 70° C./sec (the cooling rate being 100° C./sec in the illustrated example). After that, the thinner stock is subjected to overaging without being cooled in the roll cooling zone. Therefore, the water-cooled rolls 36 in the roll-cooling zone are retracted away from the strip S as shown at (a) in FIG. 10. On the other hand, the heat cycle for the heavier stock (1.0 mm thick in the illustrated example) comprises preliminary slow cooling at a temperature between the soaking temperature and a temperature not higher than the $A_1$ transformation point effected in the gas-jet cooling zone (the cooling rate being 10° C./sec in the illustrated example), quenching at a cooling rate of 100° C./sec in the roll-cooling zone, and subsequent overaging, as indicated by a broken line in FIG. 9. In this mode of operation, the water-cooled rolls 36 are kept in contact with the strip S as shown at (b) in FIG. 10.

Slow cooling is started at the soaking temperature that varies with the type and grade of steel and product, generally ranging between 700° C. and 850° C. for cold-rolled strip. The temperature at which quenching is started should metallurgically be not higher than the $A_1$ transformation point. Because of the need to keep the strip in good shape, the quenching starting temperature is generally set between 650° C. and 700° C. With the exception of some special materials, quenching is usually completed at a temperature of about 400° C. whence overaging is started.

This invention is by no means limited to the preferred embodiment described above. For example, the furnace chamber in the roll-cooling zone may of a vertical design. A vertical furnace chamber in the roll-cooling zone permits reducing the line length, although its maintainability is lower than that of a horizontal chamber. Also, the water-cooled rolls may not be driven.

While the upper water-cooled rolls may be moved up and down by hydraulic cylinders, the lower water-cooled rolls may be moved up and down by screw shafts. Or both upper and lower water-cooled rolls may be moved up and down either by screw shafts or hydraulic cylinders.

What is claimed is:

1. A method of cooling steel strip continuosly and longitudinally passed through a cooling zone of a continuous annealing line comprising the steps of:

slowly cooling the steel strip to a desired temperature at a cooling rate of not higher than 20° C./sec with a jet stream of cooling gas ejected against the surface thereof; and quenching the steel strip to a desired temperature at a cooling rate of not lower than 70° C./sec subsequent to said slow cooling, quenching being effected either by high-speed gas-jet cooling or roll cooling depending on the thickness of the strip, high-speed gas-jet cooling being applied to thinner strip that can be quenched at a cooling rate of not lower than 70° C./sec by means of a cooling gas ejected thereagainst and roll cooling effected by bringing the strip into contact with the perimeter of coolant-cooled rolls being applied to heavier strip that cannot be quenched at a cooling rate of 70° C./sec by means of the ejected cooling gas.

2. The cooling method according to claim 1, in which the thinner strip has a maximum thickness of 0.7 mm and the heavier strip has a minimum thickness of 0.5 mm.

3. A cooling apparatus in a continuous annealing line for continuously processign longitudinally passed steel strip comprising:

a high-speed gas-jet cooling zone in which the steel strip is cooled by a jet stream of cooling gas ejected against the surface thereof; and a roll cooling zone disposed directly downstream of the high-speed gas-jet cooling zone comprising a plurality of cooling rolls for cooling the steel strip that is brought into contact therewith, means for exerting longitudinal tension on the steel strip travelling through the roll cooling zone being provided at the entry and exit end of the roll cooling zone.

4. The cooling apparatus according to claim 3, in which the high-speed gas-jet cooling zone has a capacity to cool 0.5 mm thick steel strip at a rate of not lower than 70° C./sec and the roll cooling zone has a capacity to cool 2.0 mm thick steel strip at a rate of not lower than 70° C./sec.

5. The cooling apparatus according to claim 3, in which the high-speed gas-jet cooling zone comprises:

a furnace chamber providing a passage for the steel strip;

a pair of gas ejection boxes mounted on furnace walls so as to lie on both sides of the strip with the front side of the boxes facing the strip surface;

a plurality of nozzles directed toward the strip surface and attached to the front side of each gas ejection box, the travelling strip being cooled by a pressurized gas stream ejected from the nozzles;

forced gas circulation means communicating with the furnace chamber through an intake pipe and with the gas ejection box through a discharge pipe; and gas cooling means provided midway on the intake pipe; and the roll cooling zone comprises:

a furnace chamber providing a passage for the steel strip;

a series of cooling rolls zigzagged on both sides of and along the pass line of the strip, each cooling roll being supplied with a coolant to cool the roll body; and drive means for changing the position of the cooling roll so that the surface thereof is brought into and out of contact with the strip.

6. The cooling apparatus according to claim 5, in which the nozzles are projected from that surface of the gas ejection box which faces the steel strip.

7. The cooling apparatus according to claim 5, in which the steel strip and the nozzle tip are separated from each other by a distance of not more than 100 mm.

8. The cooling apparatus according to claim 5, in which the tension exerting means comprises bridle rolls provided at the entry and exit ends of the furnace chamber in the roll cooling zone.

9. The cooling apparatus according to claim 5, in which the continuous annealing line comprises a heating furnace, a soaking furnace, a primary cooling furnace, an overaging furnace and a secondary cooling furnace disposed in that order, the first cooling furnace comprising said cooling apparatus.

* * * * *